United States Patent [19]

Cavaness

[11] Patent Number: 4,815,355

[45] Date of Patent: Mar. 28, 1989

[54] COLOR CHANGEABLE GUITAR BODY

[76] Inventor: Jack D. Cavaness, 757 Willow St., Hurst, Tex. 76053

[21] Appl. No.: 143,678

[22] Filed: Jan. 14, 1988

[51] Int. Cl.[4] ..... G10D 3/00

[52] U.S. Cl. ..... 84/291

[58] Field of Search ..... 84/291

[56] References Cited

U.S. PATENT DOCUMENTS

| | | | |
|---|---|---|---|
| 2,588,101 | 3/1952 | Finder | 84/291 |
| 4,144,793 | 3/1979 | Soika | 84/291 |
| 4,213,370 | 9/1980 | Jones | 84/291 |
| 4,313,362 | 2/1982 | Lieber | 84/291 X |
| 4,334,452 | 6/1982 | Morrison | 84/291 X |
| 4,745,837 | 5/1988 | Rimsa | 84/291 |

*Primary Examiner*—L. T. Hix

*Assistant Examiner*—Brian W. Brown

[57] ABSTRACT

A clear plastic hollow guitar body 20 with sides 25 which are vacuum formed together and having an attached back 24 and a colored liquid 32 which has the ability to be changed to a different color by draining from drain hole 33 and refilling through fill hole 34. It has waterproof electronic pickup boxes 26 attached inside the body and connected by tubes 27 to the volume switches 28, the off and on switches 29, and the input jack 30, thus making all electronic parts moisture proof.

2 Claims, 2 Drawing Sheets

COLOR CHANGEABLE GUITAR BODY

BACKGROUND--FIELD OF INVENTION

This invention relates to electrical guitars, and more specifically to a guitar body formed of crystal plastic with a back plate, which is sealed and attached with screws, hollow in the middle, and filled with a colored liquid formula that produces the color of the guitar from the inside.

BACKGROUND--DESCRIPTION OF PRIOR ART

Heretofore, guitars of the past were manufactured of wood, metal, and plastic. In all cases, the final body was either painted, clear lacquered, or some type of plastic coating, such as colored fiberglass, was used to produce the color of the final product. This means the bodies must be sanded and recoated to change the color. This is an expensive and time consuming process and sometimes even effects the sound. Most guitar players are stuck with one color or are forced to buy more than one guitar if they wish to have more than one color. Many professional musicians have 20 or 30 or more guitars, all of different colors. This tends to create a storage, as well as a transporting problem when they are on tour. Thus, with the color changeable guitar body you can drain the colored liquid and refill it with another color time after time. This process will only take minutes to complete.

OBJECTS AND ADVANTAGES

Accordingly several objects and advantages of my invention are to provide a more economical and less time consuming process to produce a guitar body which can be any color available by simply draining and refilling the liquid content at will. These points show obvious advantages over the conventional wood or plastic guitars. In addition, we can divide the body into sections and have multicolored designs or write a signature with tubing, which can be filled with colored liquid and changed as well as the rest of the body. The conventional wood and plastic guitars on the market today are very limited in color, and it is very costly to change colors. Thus, we have produced the most versatile and colorful body ever to come on the market. Further objects and advantages of my invention will become apparent from a consideration of the drawings and ensuing description of it.

DRAWING FIGURES

DRAWING REFERENCE NUMERALS

20-front of body.
21-holes cut out for pickups.
22-cut out for neck.
23-screw holes in the back plate.

24-back plate.
25-interigally formed side walls.
26-boxes mounted under the front cover.
27-tubes for waterproofing wiring.
28-holes for volume knobs.
29-holes for mini switches.
30-hole for input jack.
31-screws for mounting back plate.
32-view of body filled with liquid.
33-drain hole.
34-fill hole.

DESCRIPTION OF INVENTION

Figure 1:
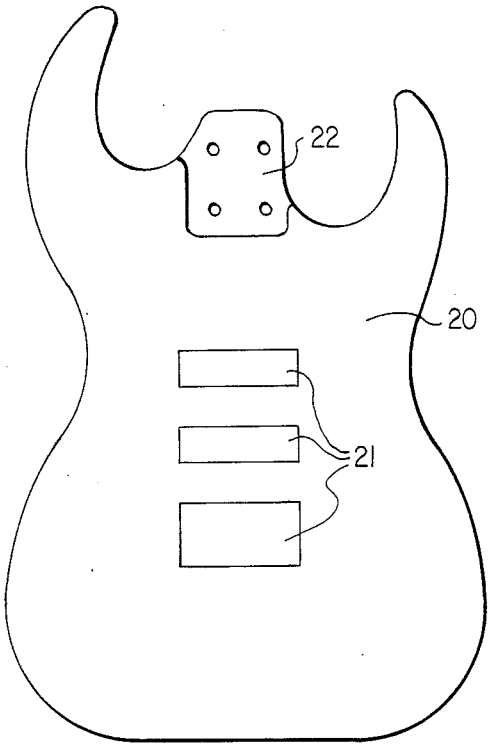
FIG. 1 shows a front view of the body with cut outs for pickups and a recess place for the attachment of a wooden neck.
Figure 2:
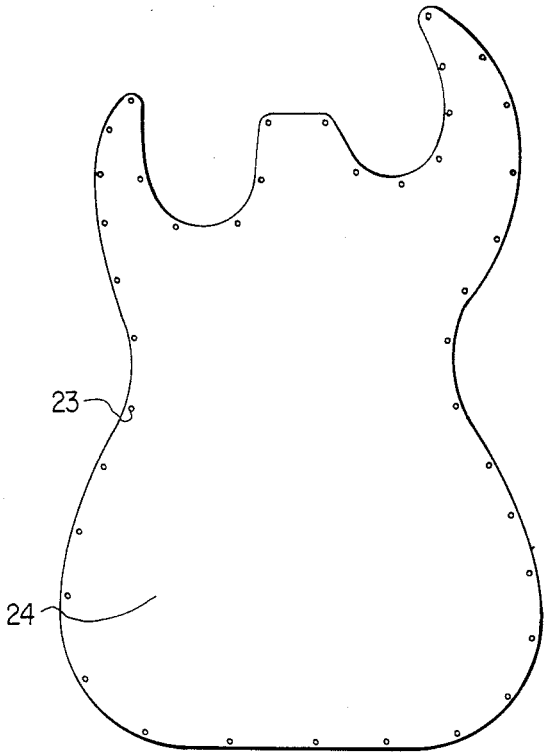
FIG. 2 shows back plate with holes drilled and counter sunk for screws.
Figure 3:
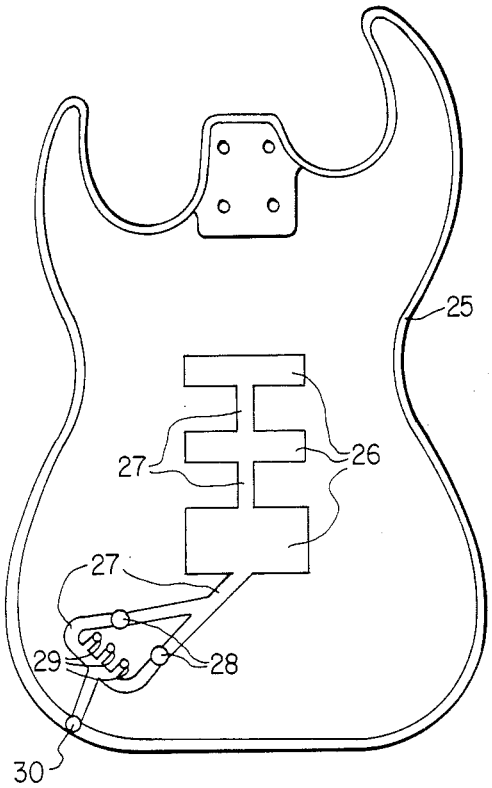
FIG. 3 shows inside hollow body of FIG. 1 with pickup boxes, wiring tubes, side walls, and holes to attach the neck.
Figure 4:
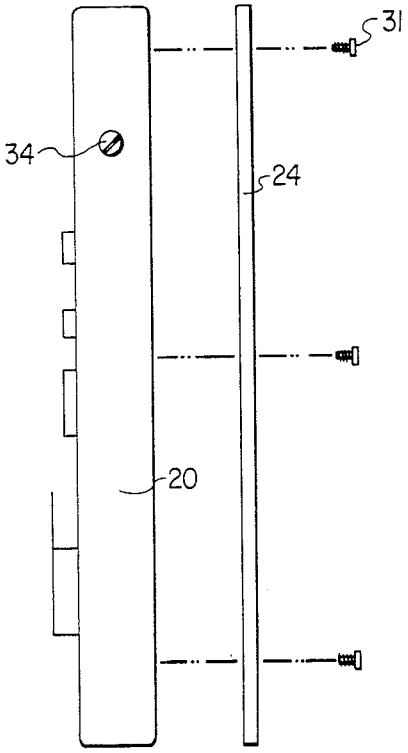
FIG. 4 shows a side view of FIG. 1 attaching to FIG. 2 with screws.
Figure 5:
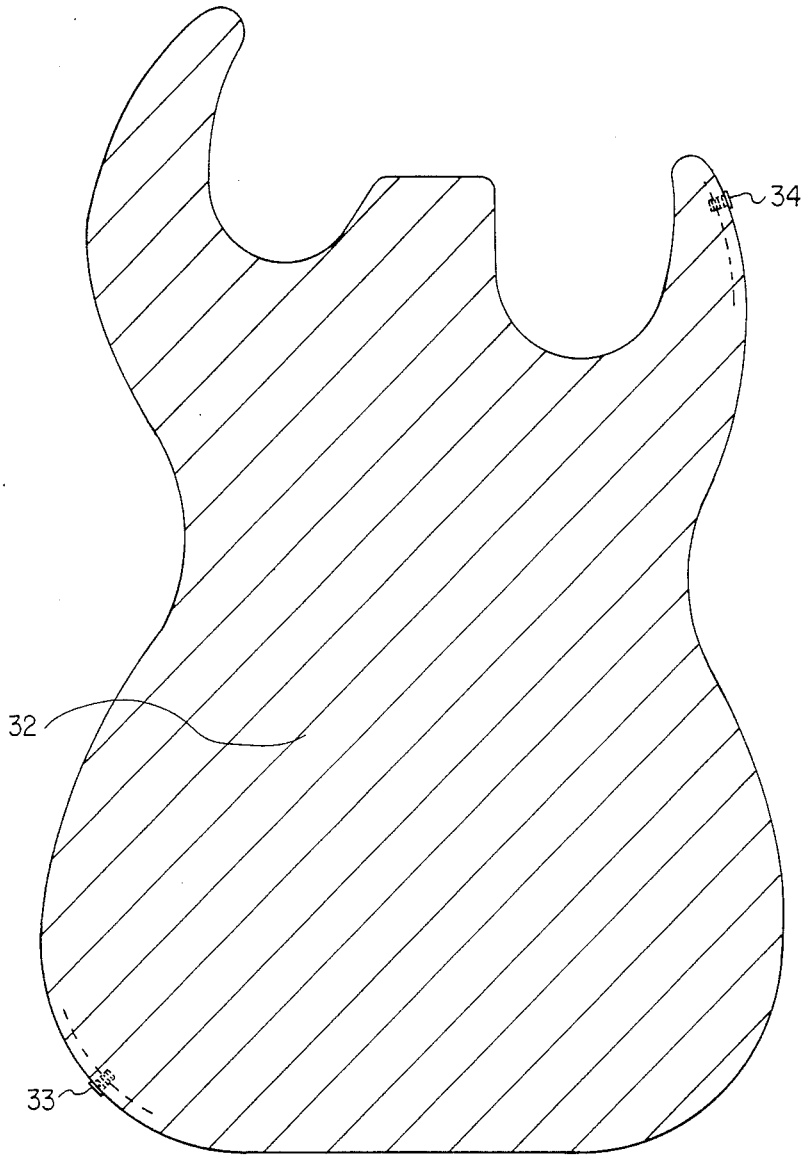
FIG. 5 shows body filled with liquid.

FIG. 1 shows a clear plastic guitar body 20 which has cutouts 21 for electronic pickup devices and a recess 22 for the purpose of attaching a wooden neck. FIG. 2 is a back plate 24 with screw holes 23 which seals and attaches to the back of the body 20 with screws 31 to contain the liquid formula 32. FIG. 3 is an inside look at the body 20 from the back side. It shows the interigal formed sides 25 which are formed with the body 20. It shows boxes 26 attached and sealed to the underneath side of the body 20 for the purpose of keeping the electronic pickups dry. The plastic tubes 27 house the electronic wires, the volume switches, mini off and on switches, and the input jack so that no moisture can reach any electronic parts. The electronic parts carry less than 10 volts and there is not a threat to electrocute the operator. FIG. 4 is a side view of the body 20 and the back plate 24 showing how they attach with screws 31. FIG. 5 is a front view of the guitar body assembled with the liquid 32 inside and a drain hole 33 and fill hole 34 at opposite ends of the body.

Thus, the reader will see that the guitar body of this invention is a far step beyond any guitar on the market today. It is versatile in the fact you can change the colored liquid inside to another color in a matter of minutes and it has great economical value in the fact one or two color changeable Guitar bodies can take the place of 20 or 30 conventional ones. Thus, solving a storage and transportation problem of many bands. While my above description contains many specifications, these should not be construed as limitations on the scope of the invention, but rather as an exemplification of one preferred embodiment thereof. Many other variations are possible. For example, on the underneath side of the body 20 we could paint or inlay plastic stripes of black or white, thus creating a tiger striped guitar of any color with black or white stripes, or the body 20 can be sectioned off in various ways to produce multi-colored bodies, and with help of some tubing, a person's name could be placed inside and filled with liquid prodcuing a signature model guitar. Accordingly, the reader is requested to determine the scope of the invention by the appended claims and their legal equivalents, and not by the examples which have been given.

I claim:

1. An electric guitar body comprising:

a one piece, clear plastic body having sides formed therewith, a clear plastic back piece attached to said body at said sides and forming a hollow interior, said hollow interior being filled with a colored liquid for imparting a color to said body, said body having means for draining and refilling said hollow interior, whereby said body is given any desired color, a plurality of pick-up boxes are mounted to said body inside said hollow interior for housing and sealing electronic pick-up devices from said liquid, a plurality of plastic tubes mounted inside said hollow interior and connecting said pick-up boxes to desired locations on said body for housing and sealing from said liquid a plurality of wires for connecting said electronic pick-up devices to volume knobs, on/off switches and an output jack. --

2. The electric guitar body of claim 1 wherein said hollow interior is sectioned off to produce a multi-colored body.

* * * * *